US010701477B2

(12) United States Patent
Enenkl et al.

(10) Patent No.: US 10,701,477 B2
(45) Date of Patent: Jun. 30, 2020

(54) LOUDSPEAKER, ACOUSTIC WAVEGUIDE, AND METHOD

(71) Applicant: Sony Corporation, Tokyo (JP)

(72) Inventors: Michael Enenkl, Stuttgart (DE); Thomas Kemp, Stuttgart (DE); Patrick Putzolu, Stuttgart (DE); Andreas Schwager, Stuttgart (DE)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/361,260

(22) Filed: Mar. 22, 2019

(65) Prior Publication Data

US 2019/0306616 A1 Oct. 3, 2019

(30) Foreign Application Priority Data

Mar. 27, 2018 (EP) ..... 18164264

(51) Int. Cl.

| | |
|---|---|
| ***H04R 1/02*** | (2006.01) |
| ***H04R 1/28*** | (2006.01) |
| ***H04R 1/24*** | (2006.01) |
| ***H04R 1/34*** | (2006.01) |
| ***H04R 5/02*** | (2006.01) |
| ***H04R 9/06*** | (2006.01) |

(52) U.S. Cl.

CPC ..... *H04R 1/2853* (2013.01); *H04R 1/02* (2013.01); *H04R 1/24* (2013.01); *H04R 1/345* (2013.01); *H04R 5/02* (2013.01); *H04R 9/063* (2013.01); *H04R 2201/025* (2013.01); *H04R 2499/13* (2013.01)

(58) Field of Classification Search

USPC ..... 381/337, 338, 339, 340, 341, 345, 350, 381/358, 162, 386, 387, 411

See application file for complete search history.

(56) References Cited

U.S. PATENT DOCUMENTS

| | | | | |
|---|---|---|---|---|
| 5,212,732 | A | 5/1993 | Hipps et al. | |
| 7,024,014 | B1 | 4/2006 | Noll | |
| 8,130,994 | B2 | 3/2012 | Button et al. | |
| 8,807,268 | B2 | 8/2014 | Dodd | |
| 8,938,084 | B2 | 1/2015 | Arai | |
| 9,294,832 | B2 | 3/2016 | Suvanto et al. | |
| 2007/0186895 | A1* | 8/2007 | Ochi | F02M 35/14 123/198 E |
| 2013/0200966 | A1* | 8/2013 | Michaelsen | H01F 7/066 335/261 |

(Continued)

FOREIGN PATENT DOCUMENTS

| | | |
|---|---|---|
| CN | 201312379 Y | 9/2009 |
| CN | 202282842 U | 6/2012 |
| CN | 205051860 U | 2/2016 |

(Continued)

OTHER PUBLICATIONS

European Search Report dated Aug. 19, 2019 in European Application No. 19164353.5.

(Continued)

*Primary Examiner* — Walter F Briney, III

(74) *Attorney, Agent, or Firm* — Xsensus LLP

(57) ABSTRACT

A loudspeaker comprising an acoustic waveguide (210), the acoustic waveguide (210) being configured to change its shape in order to change the directivity of sound emitted by the loudspeaker

17 Claims, 4 Drawing Sheets

(56) References Cited

U.S. PATENT DOCUMENTS

| | | | | |
|---|---|---|---|---|
| 2015/0078580 | A1* | 3/2015 | Schwerdtfeger ..... | H04R 1/323<br>381/86 |
| 2019/0246202 | A1* | 8/2019 | Winton ..... | H04R 1/2803 |

FOREIGN PATENT DOCUMENTS

| | | | |
|---|---|---|---|
| DE | 3603537 | A1 | 8/1987 |
| EP | 334217 | A2 | 9/1989 |
| EP | 1059830 | A2 | 12/2000 |
| EP | 3 506 648 | A1 | 3/2019 |
| JP | 5846797 | A | 3/1983 |
| JP | 2013-031856 | A | 2/2013 |
| JP | 5213802 | B2 | 6/2013 |
| WO | 96/29843 | A1 | 9/1996 |
| WO | 03/030583 | A2 | 4/2003 |
| WO | 2014/190423 | A1 | 12/2014 |
| WO | 2017/211365 | A1 | 12/2017 |

OTHER PUBLICATIONS

Audico, “Elan Elios E72D—7" In-Ceiling Dual Voice Coil Speaker Stationary Woofer—Each”, 3 pages.

* cited by examiner

LOUDSPEAKER, ACOUSTIC WAVEGUIDE, AND METHOD

CROSS-REFERENCE TO RELATED APPLICATION

The present application claims priority to European Patent Application 18164264.6 filed by the European Patent Office on Mar. 27, 2018, the entire contents of which being incorporated herein by reference.

TECHNICAL FIELD

The present disclosure generally pertains to the field of acoustics, in particular to the design of loudspeakers and to an acoustic waveguide.

TECHNICAL BACKGROUND

A loudspeaker cabinet (or speaker box) is an enclosure in which speaker drivers (e.g., loudspeakers and tweeters) and associated electronic hardware are mounted. Depending on the design, the loudspeaker cabinet significantly influences the reproduction characteristics of the sound transducers used. Especially in the low frequency range, the loudspeaker cabinet is used to avoid an acoustic short circuit.

In loudspeaker design, waveguides are used to control the directivity of a speaker. Acoustic waveguides are used to create a certain radiation pattern of a speaker box. Such guides are designed to provide a specific directivity pattern.

Although loudspeaker with acoustic waveguides do exist, it is generally desirable to improve the design of loudspeakers and speaker boxes.

SUMMARY

According to a first aspect the disclosure provides a loudspeaker comprising an acoustic waveguide, the acoustic waveguide being configured to change its shape in order to change the directivity of sound emitted by the loudspeaker.

According to a further aspect the disclosure provides a method comprising changing the shape of an acoustic waveguide in order to change the directivity of sound emitted by a loudspeaker.

According to a further aspect the disclosure provides an acoustic waveguide, the acoustic waveguide being configured to change its shape in order to change the directivity of sound received from a sound source.

According to a further aspect the disclosure provides a method comprising changing the shape of an acoustic waveguide in order to change the directivity of sound emitted by a sound source.

Further aspects are set forth in the dependent claims, the following description and the drawings.

BRIEF DESCRIPTION OF THE DRAWINGS

Embodiments are explained by way of example with respect to the accompanying drawings, in which.

DETAILED DESCRIPTION OF EMBODIMENTS

Figure 1:
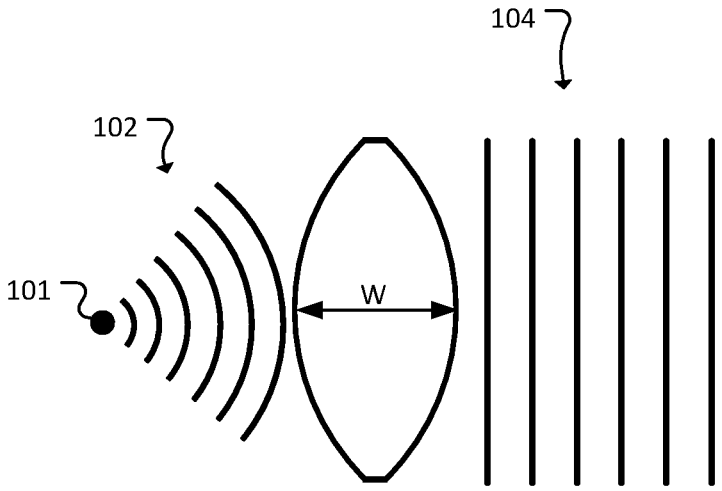
FIG. 1 schematically shows an acoustic lens for waveguiding an acoustic signal.

The embodiments described below in more detail provide a loudspeaker comprising an acoustic waveguide, the acoustic waveguide being configured to change its shape in order to change the directivity of sound emitted by the loudspeaker.

The flexible acoustic waveguide may guide the acoustic sound produced by the loudspeaker according to multiple alternative directivity patterns. The flexible acoustic waveguide may comprise walls or other media. The flexible acoustic waveguide may for example comprise elements with different rigidities so that the acoustic waveguide may be able to alter a shape mechanically or electromagnetically.

The loudspeaker may be an electroacoustic transducer which converts an electrical audio signal into corresponding sound. In particular, the loudspeaker may be a woofer, i.e. a speaker that is sized and constructed so that it can reproduce low or low and mid-range frequencies well.

The flexible acoustic waveguide may change its shape to adjust the directivity of the loudspeaker depending on a desired pattern, e.g. depending on an environment or a listening position.

Changing the shape of the acoustic waveguide and thus the directivity of sound emitted by the loudspeaker may for example allow a flexible adaptation of the loudspeaker to different rooms or listening positions. For example, the sound emitted by the loudspeaker may be focused at the position of a listener that has been previously captured by a sensor, e.g. one or more cameras or other sensors. Alternatively, by changing the shape of the acoustic waveguide, the sound emitted by the loudspeaker may be focused at a position that is defined by a user input. Still alternatively, the shape of the acoustic waveguide may be changed based on information of an external device, which can scan the room and/or environment.

The shape of acoustic waveguide may for example determine the sweet spot of the loudspeaker. When the directivity of the acoustic waveguide is low, an acoustic wave having a smaller directivity is produced. When the directivity of the acoustic waveguide of the acoustic waveguide is strong, an acoustic wave having a stronger directivity is generated.

The acoustic waveguide may comprise a speaker plate that is configured to support a speaker driver. The speaker driver may be a device that converts electrical signals into sound as the result of an electro-mechanical process. The speaker driver may for example be a dynamic speaker, a tweeter, or the like.

The acoustic waveguide may for example be configured to dynamically change its opening angle. A waveguide with smaller opening angle may result in a small sweet spot, but excellent spatial reproduction, where as a waveguide with wider opening may have a big sweet spot, but a more flat spatial reproduction.

The acoustic waveguide may comprise adjustable elements. An acoustic waveguide may for example consist of adjustable elements that are connected by some flexible parts.

The loudspeaker may further comprise an adjustment device that is configured to dynamically change the shape of the acoustic waveguide. The adjustment device may for example be configured to control the position of a speaker plate and/or speaker driver within a loudspeaker box.

The adjustment device may be configured to change the shape of the acoustic waveguide mechanically. A motor, such as a stepper motor may be as adjustment device. The motor may for example be connected with a pin to the speaker plate.

Alternatively, the adjustment device may be configured to change the shape of the acoustic waveguide electromagnetically. In order to change the shape of the acoustic waveguide electromagnetically, the speaker plate or a solid ring to which the speaker plate is attached may be made of a conductor (metal), for example iron. When a magnetic field is applied to the solid ring, the solid ring may be pulled toward the magnetic field. In addition or alternatively, iron threads or wires may be disposed in the flexible parts and/or the rigid parts of the acoustic waveguide. When a magnetic field is applied, the shape of the acoustic waveguide is changed depending on the electrical current through the iron threads or wires. The amount and the direction of the current may give the moving force for modifying the shape of the acoustic waveguide.

The acoustic waveguide may comprise one or more flexible parts. The flexible part may be able to extend or shrink (compress) so that the shape of the acoustic waveguide may be changed. The flexible parts may for example be made of an elastic material such as rubber, an elastomer, etc.

In addition or alternatively, the acoustic waveguide may comprise one or more rigid parts. The rigid parts may for example be solid rings or the like. The rigid parts may be made out wood, metal, or the like. The flexibility of the acoustic waveguide may maintain by the parts with lower rigidity, whereas the needed stiffness may be provided by the rigid elements.

The embodiments also disclose a method comprising changing the shape of an acoustic waveguide in order to change the directivity of sound emitted by a loudspeaker. The method further comprising obtaining a desired directivity and changing the directivity of sound emitted by the loudspeaker to the desired directivity.

According to an embodiment, an acoustic waveguide may be configured to change its shape in order to change the directivity of sound received from a sound source, wherein the sound source is an external sound source.

The external sound sources may be an exhaust pipe of a car, in such cases the chassis of the car is constructed to guide the sound into the room of the driver. Alternatively, the external sound source may be a siren of an emergency car being located behind the acoustic waveguide. The acoustic waveguide may be located at the rear window, and thus allows to focus the siren to the driver's seat.

The embodiments also disclose a method changing the shape of an acoustic waveguide in order to change the directivity of sound emitted by a sound source.

FIG. 1 schematically shows an acoustic lens for waveguiding an acoustic signal. A sound source 101 generates an acoustic sound signal 102 that propagates to an acoustic lens 103. The acoustic lens 103 refracts the sound signal 102 into a certain angular range 104. The specific shape of acoustic lens 103 (here schematically represented by thickness W of the acoustic lens) defines the refraction characteristics. An acoustic lens with smaller thickness results in a small sweet spot, but enhanced spatial reproduction, whereas an acoustic lens with wider opening has a big sweet spot, but a more flat spatial reproduction.

Figure 2A:
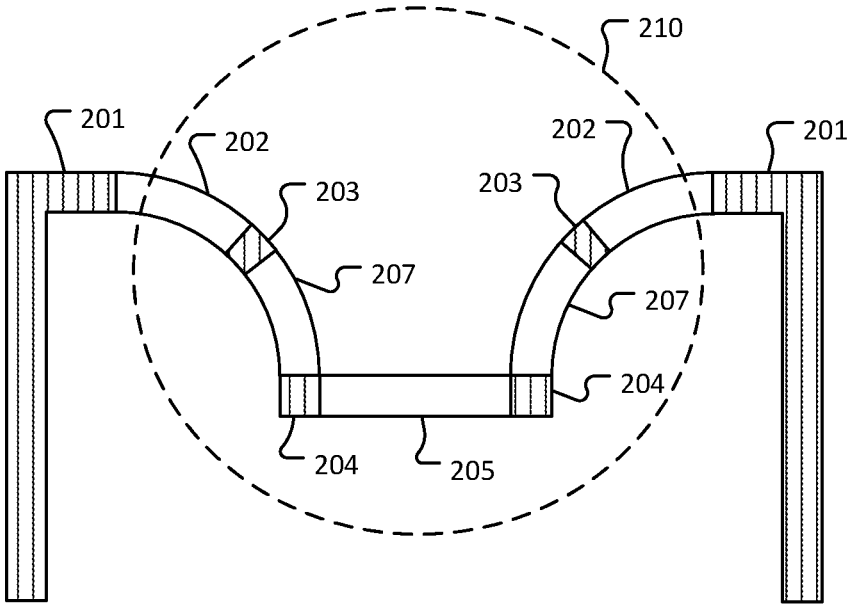
FIG. 2*a* schematically shows in a cross sectional view a loudspeaker with a flexible acoustic waveguide in a deep setting of the speaker plate.

FIG. 2*a* schematically shows, in a cross sectional view, a loudspeaker with a flexible acoustic waveguide in a deep setting of the speaker plate. A speaker plate (bass plate) 205 of circular shape is located in a speaker box 201. The speaker plate 205 supports a speaker driver (not shown) that acts as a sound source. The speaker plate 205 generates an acoustic wave. The speaker plate 205 is carried by a flexible acoustic waveguide 210. The flexible acoustic waveguide 210 comprises flexible parts 202, 207 and rigid parts 203 and connection interfaces 204. The flexible parts 202 and 207 are made out of an elastic material, such as rubber, an elastomer, etc., and they have the shape of a surface of revolution. The rigid parts 203 and connection interfaces 204 are made out of solid material, such as wood, plastic, metal, etc., and they may have a ring shape. The rigid parts 203 and connection interfaces 204 may for example be made out of the same material as speaker box 201. The speaker plate 205 is connected to the flexible part 207 by connection interfaces 204. The rigid parts 203 are connected to the flexible parts 202 and 207, respectively. The flexible part 202 is connected to the speaker box 201. By means of the flexible acoustic waveguide 210 the speaker plate 205 can be moved outwards and inwards. FIG. 2*a* represents a deep setting of the speaker plate 205 where the speaker plate 205 is placed in its deep position.

Figure 2B:
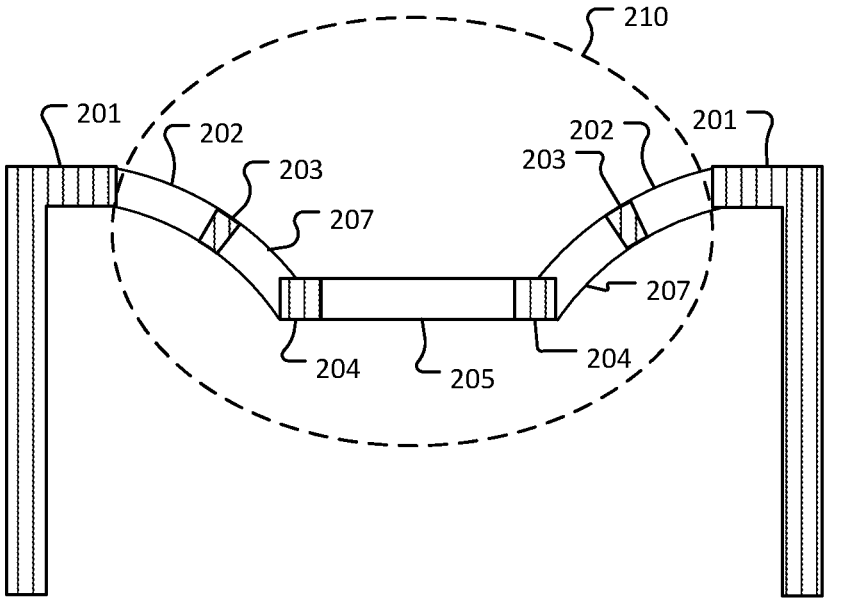
FIG. 2*b* schematically shows in a cross sectional view a loudspeaker with a flexible acoustic waveguide in a shallow setting of the speaker plate.

FIG. 2*b* schematically shows, in a cross sectional view, the loudspeaker with a flexible acoustic waveguide in a shallow setting of the speaker plate. The structure of the loudspeaker with flexible acoustic waveguide 210 is identical to the structure of FIG. 2*b*. FIG. 2*b* represents the state where the speaker plate 205 is placed in the shallow position. The flexible parts 202 and 207 are compressed, hence, the speaker plate (bass plate) 205 is pulled closer to the surface of the speaker box 201.

Figure 3:
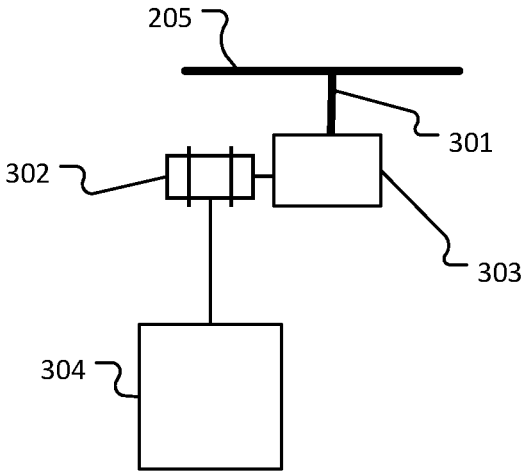
FIG. 3 schematically shows an adjustment device that is configured to adjust the shape of the acoustic waveguide.

FIG. 3 schematically shows an adjustment device that is configured to adjust the shape of the acoustic waveguide (210 in FIGS. 2*a, b*). The adjustment device may for example be configured to change the position of a speaker plate (205 in FIGS. 2*a, b*) within a speaker box (201 in FIGS. 2*a, b*). The adjustment device comprises a pin 301 that is attached to a speaker plate 205 and that is driven by a stepping motor 302 that is connected to the pin 301 via a gear unit 302. The stepping motor 302 is electronically controlled by a controller 304. The adjustment device is arranged to move the speaker plate 205 into an arbitrary position between the two limiting positions, shallow and deep. The adjustment device may be controlled by circuitry or software.

Figure 4A:
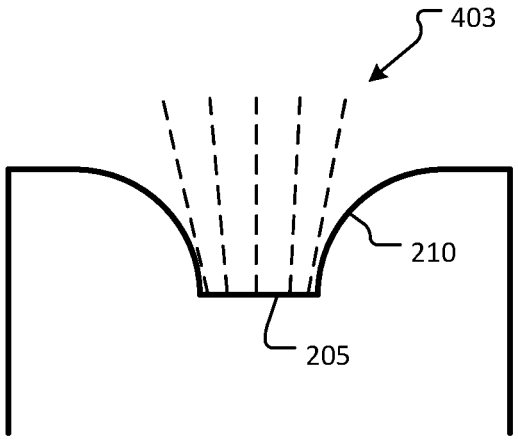
FIGS. 4*a* and 4*b* represent the waveguide characteristics of a loudspeaker in two positions of a speaker plate.
Figure 4B:
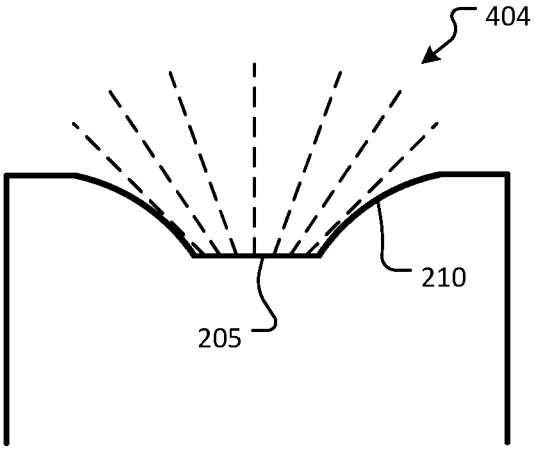

FIGS. 4*a* and 4*b* represent the waveguide characteristics of the loudspeaker in two positions of a speaker plate. FIG. 4*a* shows the speaker plate 205 in its deep setting. In the deep setting, sound produced at the speaker plate 205 is shaped by the flexible acoustic waveguide 210 into an acoustic wave 403 with high directivity. FIG. 4*b* shows the speaker plate 205 in its shallow setting. In the shallow setting, sound produced at the speaker plate 205 is shaped by the flexible acoustic waveguide 210 into an acoustic wave 404 with low directivity. FIGS. 4*a* and 4*b* show only two settings of the speaker plate. However, by means of the adjustment device described above it is also possible to have several settings, to adjust the directivity of the acoustic wave according to the requirements.

The embodiment described above shows only one possible implementation of the variable waveguide. Other variable waveguides may be used. In general, the flexible acoustic waveguide may consist of elements with different rigidities so that the acoustic waveguide may be able to alter a shape mechanically or electromagnetically. For example, an iris-like lamellar structure is also suitable to dynamically shape the sound emitted by a loudspeaker. Still further, the variable waveguide may be an acoustic lens, the surface of which is made of rubber including some iron threads or wires. When the lens is placed in a magnetic field, the shape of the lens may be deformed depending on the flow of electric current on the threads or wires. The amount of current will give the force moving the shape into the desired form.

In the embodiments described above, the acoustic waveguide is part of a loudspeaker. As an alternative embodiment, an acoustic waveguide is provided which is not part of a loudspeaker, but which is separate device which can be positioned at any place to change the directivity of sound. For example, the acoustic waveguide may be placed close to a loudspeaker, or it may be positioned on a loudspeaker (without being fixed to the loudspeaker). That is, there may be a speaker creating the sound and the acoustic waveguide may focus the sound into any direction.

Still further, the acoustic waveguide may be used to change the directive of sound produced by other external sound sources than a loudspeaker. The external sound sources may for example be an exhaust pipe of a car. In such cases the chassis of the car may be constructed to guide the sound into the room of the driver. Alternatively, the external sound source may be a siren of an emergency vehicle being located behind the acoustic waveguide. The acoustic waveguide may be located at the rear window of a car and may be configured to focus the siren to the driver's seat. The directivity pattern may be based on the type of sound source, for example, if an emergency vehicle located behind the vehicle generates a siren, the acoustic waveguide may be used in a shallow position (see FIG. 2*b*). Therefore, the siren of the emergency vehicle can be focused on the position of a driver's seat.

Note that the present technology can also be configured as described below.

[1] A loudspeaker comprising an acoustic waveguide (210), the acoustic waveguide (210) being configured to change its shape in order to change the directivity of sound emitted by the loudspeaker.

[2] The loudspeaker of [1], wherein the acoustic waveguide consists of adjustable elements.

[3] The loudspeaker of [1] or [2], wherein the acoustic waveguide is configured to change its opening angle.

[4] The loudspeaker of anyone of [1] to [3], wherein the shape of the acoustic waveguide is changed depending on an environment condition or on a listening position.

[5] The loudspeaker of [4], wherein the listening position is obtained by a sensor.

[6] The loudspeaker of anyone of [1] to [5], wherein the acoustic waveguide (210) is configured to change its shape depending on a desired directivity pattern.

[7] The loudspeaker of anyone of [1] to [6], wherein the acoustic waveguide comprises a speaker plate that is configured to support a speaker driver.

[8] The loudspeaker of anyone of [1] to [7], further comprising an adjustment device that is configured to change the shape of the acoustic waveguide.

[9] The loudspeaker of [8], wherein the adjustment device is configured to control the position of a speaker plate (205) and/or speaker driver within a loudspeaker box (201).

[10] The loudspeaker of [8], wherein the adjustment device is configured to change the shape of the acoustic waveguide (210) mechanically.

[11] The loudspeaker of [8], wherein the adjustment device is configured to change the shape of the acoustic waveguide (210) electromagnetically.

[12] The loudspeaker of anyone of [1] to [11], wherein the acoustic waveguide (210) comprises one or more flexible parts (202, 207).

[13] The loudspeaker of anyone of [1] to [12], wherein the acoustic waveguide (210) comprises one or more rigid parts (203, 204).

[14] A method comprising changing the shape of an acoustic waveguide (210) in order to change the directivity of sound emitted by a loudspeaker.

[15] The method of [14], further comprising obtaining a desired directivity and changing the directivity of sound emitted by the loudspeaker to the desired directivity.

[16] An acoustic waveguide (210), the acoustic waveguide (210) being configured to change its shape in order to change the directivity of sound received from a sound source.

[17] The acoustic waveguide of [16], wherein the sound source is an external sound source.

[18] A method comprising changing the shape of an acoustic waveguide (210) in order to change the directivity of sound emitted by a sound source.

The invention claimed is:

1. A loudspeaker comprising:

an acoustic waveguide comprising metallic threads or wires, the acoustic waveguide being configured to change its shape in order to change the directivity of sound emitted by the loudspeaker;

an adjustment device that is configured to change the shape of the acoustic waveguide by applying an electromagnetic field to the acoustic waveguide.

2. The loudspeaker of claim 1, wherein the acoustic waveguide consists of adjustable elements.

3. The loudspeaker of claim 1, wherein the acoustic waveguide is configured to change its opening angle.

4. The loudspeaker of claim 1, wherein the shape of the acoustic waveguide is changed depending on an environment condition or on a listening position.

5. The loudspeaker of claim 4, wherein the listening position is obtained by a sensor.

6. The loudspeaker of claim 1, wherein the acoustic waveguide is configured to change its shape depending on a desired directivity pattern.

7. The loudspeaker of claim 1, wherein the acoustic waveguide comprises a speaker plate that is configured to support a speaker driver.

8. The loudspeaker of claim 1, wherein the adjustment device is configured to control the position of a speaker plate and/or speaker driver within a loudspeaker box.

9. The loudspeaker of claim 1, wherein the acoustic waveguide comprises one or more flexible parts.

10. The loudspeaker of claim 1, wherein the acoustic waveguide comprises one or more rigid parts.

11. The loudspeaker of claim 1, wherein the acoustic waveguide further comprises rubber and the shape of the acoustic waveguide is deformed depending on a flow of an electric current through the metallic threads or wires.

12. A method for changing the shape of an acoustic waveguide comprising metallic threads or wires in order to change the directivity of sound emitted by a loudspeaker, the method comprising:

applying an electromagnetic field to the acoustic waveguide to change the shape of the acoustic waveguide, thereby changing the directivity of the sound emitted by the loudspeaker.

13. The method of claim 12, further comprising obtaining a desired directivity and changing the directivity of sound emitted by the loudspeaker to the desired directivity.

14. The method of claim 12, further comprising:

capturing a position of a listener with a sensor; and focusing the sound at the captured position.

15. An acoustic waveguide comprising metallic threads or wires, the acoustic waveguide being configured to change its shape in order to change the directivity of sound received from a sound source, wherein an adjustment device is configured to change the shape of the acoustic waveguide by applying an electromagnetic field to the acoustic waveguide.

16. The acoustic waveguide of claim 15, wherein the sound source is an external sound source.

17. A method comprising changing the shape of an acoustic waveguide comprising metallic threads or wires in order to change the directivity of sound emitted by a sound source, the method comprising:

applying an electromagnetic field to the acoustic waveguide to change the shape of the acoustic waveguide, thereby changing the directivity of the sound emitted by the sound source.

* * * * *